United States Patent [19]

Branson

[11] 4,300,606

[45] Nov. 17, 1981

[54] WOOD SPLITTING AXE

[76] Inventor: Johnny R. Branson, P.O. Box 124, Blocksburg, Calif. 95414

[21] Appl. No.: 142,099

[22] Filed: Apr. 21, 1980

Related U.S. Application Data

[63] Continuation of Ser. No. 8,864, Feb. 2, 1979, abandoned.

[51] Int. Cl.[3] ..... B26B 23/00

[52] U.S. Cl. ..... 145/2 R; 145/24

[58] Field of Search ..... 145/2 R, 2 A, 3, 24

[56] References Cited

U.S. PATENT DOCUMENTS

| | | | |
|---|---|---|---|
| D. 26,335 | 11/1896 | Barbour | 145/2 R |
| 320,736 | 6/1885 | Winzenried | 145/24 |
| 424,205 | 3/1890 | Hufford | 145/2 R |
| 667,000 | 1/1901 | Bridges | 145/2 R |
| 700,780 | 5/1902 | King | 145/2 R |
| 746,783 | 12/1903 | Blount | 145/2 R |
| 1,504,644 | 8/1924 | Rayburn | 145/2 R |
| 1,578,502 | 3/1926 | Estwing | 145/2 R |
| 1,729,365 | 9/1929 | Sells | 145/2 R |
| 1,731,874 | 10/1929 | Smith | 145/2 R |

FOREIGN PATENT DOCUMENTS

| | | | |
|---|---|---|---|
| 500107 | 2/1954 | Canada | 145/2 R |
| 173426 | 7/1906 | Fed. Rep. of Germany | 145/2 R |
| 25757 | 3/1953 | Finland | 145/2 R |
| 119033 | 7/1959 | U.S.S.R. | 145/2 R |

*Primary Examiner*—Nicholas P. Godici
*Assistant Examiner*—J. T. Zatarga
*Attorney, Agent, or Firm*—Harvey G. Lowhurst

[57] ABSTRACT

A wood splitting axe head for mounting on an axe handle in which the weight is distributed such that the plane through the center of gravity of the axe head (gravity plane) is offset with respect to the longitudinal plane through which the axe is swung and which passes through the center of the axe handle (swing plane). Further, the splitting edge of the blade is separated from the gravity plane in the direction of the swing plane and has one face parallel to the swing plane which is provided with a step to limit axe penetration into the wood and to initiate a turning motion of the axe head after impact.

3 Claims, 3 Drawing Figures

WOOD SPLITTING AXE

This is a continuation, of application Ser. No. 008,864, filed Feb. 2, 1979, now abandoned.

BACKGROUND OF THE INVENTION

This invention relates to improvements in an axe, and more particularly, to a wood splitting axe which facilitates splitting of wood along the grain.

There are a number of axes available for the splitting of wood, some of which have a single edge extending to one side of the axe head and an anvil or hammer portion extending to the other side thereof. Such prior axes are usually symmetric about a plane bisecting the axe handle opening in the axe head and extending parallel to the swing of the axe so that, upon impact, the full force of the weight of the axe exerts a downwardly directed force for a deep bite to facilitate the splitting of the wood. Also, the intersecting faces which form the splitting edge make an angle with one another to form a fairly wide wedge to assist in the splitting of the wood along the grain. These faces are again symmetric with respect to the swing plane.

An analysis of such prior are splitting axes discloses that the splitting edge lies in a plane containing the center of gravity of the axe head so that, upon impact, the handle does not turn in the hands of the splitter. This quality of an axe also is referred to as balance and is most valued as giving a good feel.

One of the problems encountered with these prior art splitting axes is that they bite into the wood and facilitate the prying apart of the wood only by the taper or wedge of the blade. The wider the blade, the more is the splitting force but opposing this effect is the fact that a thick blade does not bite deep. Therefore, a compromise has to be struck between a thick wedge for maximum splitting action and a thin wedge for maximum penetration. Additionally, such prior art axes have a tendency to stick into the wood unless the wood splits, and that to unstick the axe; it has to be wiggled or a hammer has to be used on the anvil to drive the axe downward into splitting the wood.

It is therefore an object of the present invention to provide an axe which, immediately after impact, rotates to pry apart the wood into which the edge bit.

It is a further object of the present invention to provide a splitting axe which includes a stop means to stop the downward motion of the axe head and to convert the remaining force into rotary motion after the axe head to split the wood.

It is also an object of the present invention to provide a splitting axe in which the center of gravity is offset from the plane in which the edge lies to allow, immediately after impact, a rotary torque to turn the axe head to facilitate splitting.

It is also an object of the present invention to provide an axe which has a blade shaped to prevent sticking, and to grasp the wood for prying.

It is still a further object of the present invention to provide an axe head which is more efficient in splitting wood than axe heads heretofor known and which split by axe head rotation rather than by wedging.

SUMMARY OF THE INVENTION

In accordance with the present invention, an axe head is provided whose edge plane and whose gravity plane are separated a predetermined distance to allow a rotational torque to develop after impact. The gravitational plane is defined as the plane parallel to the swing plane and passing through the center of gravity of the axe head and the edge plane is defined as the plane parallel to the swing plane and passing through the splitting edge of the axe head. Further, the blade portion has one face parallel to the swing plane which is facing away from the gravity plane.

DETAILED DESCRIPTION OF THE EMBODIMENT

Figure 1:
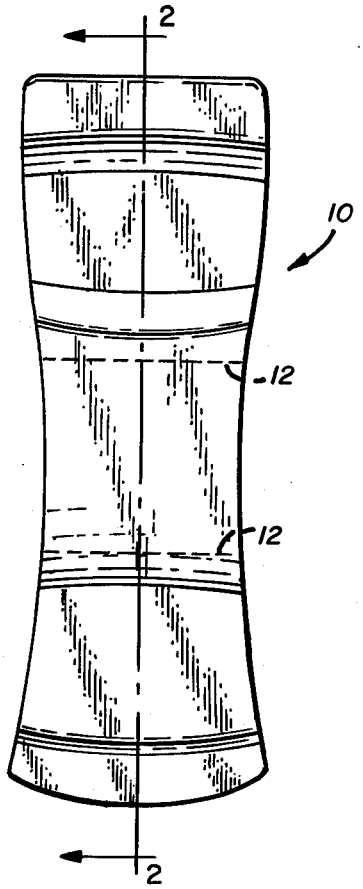
FIG. 1 is a plan view showing one side of the axe head of this invention.
Figure 2:
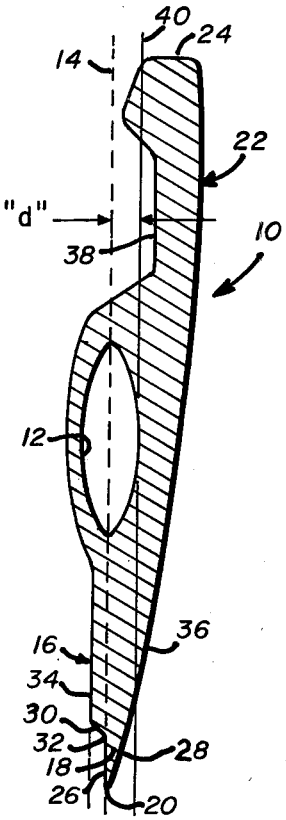
FIG. 2 is a cross-sectional view taken along lines 2—2 of FIG. 1.

Referring now to the drawing, and particularly to FIGS. 1 and 2 thereof, there is shown an axe head 10 which has a handle opening 12 which is of conventionally oval shape and which, for a "6 lb" splitting axe, would have a long dimension of 2¾ inches and a short dimension of ¾ inches. The long dimension also defines a plane 14 which bisects opening 12 and which is parallel to the "swing" of the axe and is therefore referred to as the swing plane.

Axe head 10 extends to one side to form portion 16 having a splitting blade 18 terminating in a splitting edge 20, and extending to the other side to form a portion 22 which terminates in a flat surface 24 which could be used as an anvil or hammer head. Splitting blade 18 has a face 26 which is substantially parallel to swing plane 14 to form a parallel face and a face 28 which extends rearwardly and outwardly to form a sloping face. Sloping face 28 is rounded and forms the heel of the blade and the intersection of faces 26 and 28 defines the splitting edge 20. Splitting edge 20 also defines an edge plane which is parallel to swing plane 14 and passes through splitting edge 20. Normally, the edge plane coincides with the swing plane 14, but need not and may be separated therefrom. Face 28 extends all the way to portion 22, but face 26 is planar, as shown, fairly short and terminates in a stop 30 which is formed with a rounded corner at 32 and which ends into face 34.

As is readily seen, axe head 10 is provided with a notch 38 to remove weight from the left-hand side of the axe head and to concentrate the weight on the right-hand side of the axe head. The axe head also defines a plane 40 which is parallel to the swing plane and which passes through the center of gravity of axe head 10. Axe head 10 is shaped in such a way that plane 40, also referred to as the gravity plane, is offset with respect to the edge plane by a distance "d" which is selected, as will be explained hereinafter in more detail, to provide a certain rotational torque after impact. By way of example, a "6 lb" splitting blade constructed in accordance with this invention has a face 26 of ¾ inches in length. The width of stop 30, this being the distance between faces 26 and 34, is about 3/16 inch. The length of the axe head from splitting edge 20 to surface 24 is approximately 10¼ inches while the thickness of the hammer portion increases from a width of ¾ inch at face 24 to 1-1/16 inch at the widest part. The narrowest part formed by notch 38 is 9/16 inch and the length of the notch is 2 inches. The distance "d", which is the distance of separation between the edge plane and the gravity plane, is about ⅜ inch, this dimension giving it a moment which has been found experimentally to be most effective for a "6 lb" axe.

Figure 3:
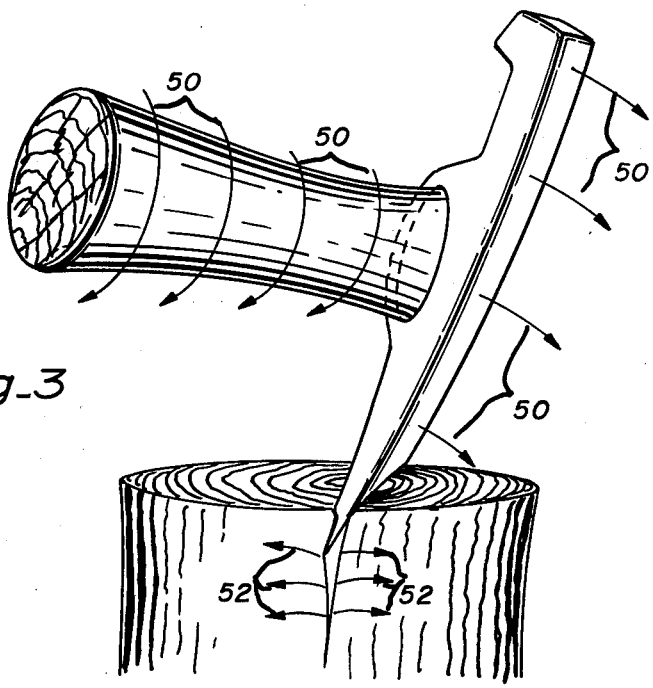
FIG. 3 is a three dimensional view useful in explaining the action of the axe head of the present invention.

Referring now to FIG. 3, there is shown a sketch which should assist in the understanding of the operation of the present invention. As the axe is forced into the wood to be split, and the downward motion of the blade has been arrested after the blade has cut into the wood and is stopped by stop 30, the axe starts rotating as shown by arrows causing the wood to split as shown by arrows 52.

What is claimed is:

1. A wood splitting axe head for mounting on an axe handle comprising:

an elongated axe head having at the very least two converging faces forming a cutting edge at the intersection thereof, said cutting edge defining an edge plane in the direction of elongation;

stop means formed on one face only a predetermined distance from said cutting edge and on one side of said edge plane;

the center of gravity of said axe head lying above said stop means in the direction away from said cutting edge and in a gravity plane in the direction of elongation which is spaced from and parallel to said edge plane and located on that side of said edge plane opposite said stop means; and said stop means and said center of gravity cooperating during the end of the swing to produce a turning motion of said axe head to convert the remaining impact force into a rotary motion after impact, thereby facilitating the splitting of wood.

2. A wood splitting axe head in accordance with claim 1 in which one of said faces is substantially planar and parallel to said edge plane.

3. A wood splitting axe head in accordance with claim 2 in which said stop means extends along said planar parallel face.

* * * * *